US007980668B2

(12) United States Patent
Silverbrook

(10) Patent No.: US 7,980,668 B2
(45) **Date of Patent: *Jul. 19, 2011**

(54) EJECTION ARRANGEMENT FOR PRINTHEAD NOZZLE

(75) Inventor: Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 43 days.

This patent is subject to a terminal disclaimer.

(21) Appl. No.: 12/558,562

(22) Filed: Sep. 13, 2009

(65) Prior Publication Data

US 2010/0002054 A1 Jan. 7, 2010

Related U.S. Application Data

(63) Continuation of application No. 12/103,708, filed on Apr. 16, 2008, now Pat. No. 7,591,540, which is a continuation of application No. 11/239,029, filed on Sep. 30, 2005, now Pat. No. 7,377,621, which is a continuation of application No. 11/177,394, filed on Jul. 11, 2005, now Pat. No. 7,370,941, which is a continuation of application No. 10/636,204, filed on Aug. 8, 2003, now Pat. No. 7,001,011, which is a continuation of application No. 10/204,211, filed as application No. PCT/AU00/00333 on Apr. 18, 2000, now Pat. No. 6,659,593.

(51) Int. Cl.
*B41J 2/04* (2006.01)

(52) U.S. Cl. ..... 347/54; 347/20; 347/65; 347/70

(58) Field of Classification Search ..... 347/54, 347/20, 65, 70

See application file for complete search history.

(56) References Cited

U.S. PATENT DOCUMENTS

| | | | | |
|---|---|---|---|---|
| 5,064,165 | A | 11/1991 | Jerman | |
| 5,821,962 | A | 10/1998 | Kudo et al. | |
| 5,841,452 | A | 11/1998 | Silverbrook | |
| 6,003,977 | A | 12/1999 | Weber et al. | |
| 6,276,782 | B1 * | 8/2001 | Sharma et al. | 347/56 |
| 6,478,406 | B1 | 11/2002 | Silverbrook | |
| 6,659,593 | B1 * | 12/2003 | Silverbrook | 347/54 |
| 6,827,425 | B2 | 12/2004 | Silverbrook | |
| 7,001,011 | B2 * | 2/2006 | Silverbrook | 347/54 |
| 7,370,941 | B2 * | 5/2008 | Silverbrook | 347/54 |
| 7,377,621 | B2 * | 5/2008 | Silverbrook | 347/54 |
| 7,581,818 | B2 * | 9/2009 | Silverbrook | 347/54 |
| 7,591,540 | B2 * | 9/2009 | Silverbrook | 347/54 |
| 2002/0184504 | A1 | 12/2002 | Hughes | |
| 2006/0038853 | A1 | 2/2006 | Silverbrook | |
| 2006/0075255 | A1 | 4/2006 | Duffy et al. | |

(Continued)

FOREIGN PATENT DOCUMENTS

| | | | |
|---|---|---|---|
| EP | 0512521 | A | 11/1992 |

(Continued)

*Primary Examiner* — Matthew Luu
*Assistant Examiner* — Henok Legesse

(57) ABSTRACT

An ejection arrangement is provided for a printhead nozzle. The arrangement has a chamber having an inlet defined by edge portions of a first side of the chamber and an ejection port defined in a second side of the chamber, and an ejection member located in the chamber between the edge portions. The ejection member is operable to cause ejection of fluid in the chamber through the ejection port and subsequent refill of fluid into the chamber through the inlet. The edge portions are configured to reduce fluid flow through a space between the edge portions and the ejection member during ejection.

2 Claims, 5 Drawing Sheets

U.S. PATENT DOCUMENTS

| | | | |
|---|---|---|---|
| 2006/0187261 | A1 | 8/2006 | Silverbrook |
| 2008/0239008 | A1 | 10/2008 | Silverbrook |

FOREIGN PATENT DOCUMENTS

| | | | | |
|---|---|---|---|---|
| EP | 0816088 | A | | 1/1998 |
| EP | 1263594 | A | | 12/2002 |
| EP | 1274583 | A | | 1/2003 |
| JP | 2150353 | A | | 6/1990 |
| JP | 07-089097 | A | | 4/1995 |
| JP | 09-174875 | A | | 7/1997 |
| JP | 09-254410 | A | | 9/1997 |
| JP | 11-010861 | A | | 1/1999 |
| WO | WO 99/03680 | | * | 1/1999 |
| WO | WO 99/65691 | A | | 12/1999 |
| WO | WO 01/66355 | A1 | | 9/2001 |
| WO | WO 01/66357 | A1 | | 9/2001 |

* cited by examiner

EJECTION ARRANGEMENT FOR PRINTHEAD NOZZLE

CROSS REFERENCE TO RELATED APPLICATION

The present application is a Continuation of U.S. application Ser. No. 12/103,708 filed Apr. 16, 2008, now issued U.S. Pat. No. 7,591,540, which is a Continuation of U.S. application Ser. No. 11/239,029 filed Sep. 30, 2005, now issued U.S. Pat. No. 7,377,621, which is a Continuation of U.S. application Ser. No. 11/177,394 filed Jul. 11, 2005, now issued U.S. Pat. No. 7,370,941, which is a Continuation of U.S. application Ser. No. 10/636,204 filed Aug. 8, 2003, now issued U.S. Pat. No. 7,001,011, which is a Continuation of U.S. application Ser. No. 10/204,211 filed on Aug. 19, 2002, now issued U.S. Pat. No. 6,659,593, which is a 371 of PCT/AU00/00333 filed on Apr. 18, 2000, all of which are herein incorporated by reference.

FIELD OF THE INVENTION

The present invention relates to the field of Micro Electro Mechanical Systems (MEMS), and specifically inkjet printheads formed using MEMS technology.

BACKGROUND OF THE INVENTION

MEMS devices are becoming increasingly popular and normally involve the creation of devices on the micron scale utilising semiconductor fabrication techniques. For a recent review on MEMS devices, reference is made to the article "The Broad Sweep of Integrated Micro Systems" by S. Tom Picraux and Paul J. McWhorter published December 1998 in IEEE Spectrum at pages 24 to 33.

MEMS manufacturing techniques are suitable for a wide range of devices, one class of which is inkjet printheads. One form of MEMS devices in popular use are inkjet printing devices in which ink is ejected from an ink ejection nozzle chamber. Many forms of inkjet devices are known.

Many different techniques on inkjet printing and associated devices have been invented. For a survey of the field, reference is made to an article by J Moore, "Non-Impact Printing: Introduction and Historical Perspective", Output Hard Copy Devices, Editors R Dubeck and S Sherr, pages 207 to 220 (1988).

Recently, a new form of inkjet printing has been developed by the present applicant, which is referred to as Micro Electro Mechanical Inkjet (MEMJET) technology. In one form of the MEMJET technology, ink is ejected from an ink ejection nozzle chamber utilizing an electro mechanical actuator connected to a paddle or plunger which moves towards the ejection nozzle of the chamber for ejection of drops of ink from the ejection nozzle chamber.

The present invention concerns modifications to the structure of the paddle and/or the walls of the chamber to improve the efficiency of ejection of fluid from the chamber and subsequent refill.

SUMMARY OF THE INVENTION

In accordance with a first aspect of the invention there is provided a liquid ejection device including:

a fluid chamber having:

a fluid outlet port in a wall of the chamber;

a fluid inlet port in a wall of the chamber;

a paddle located in the chamber and moveable in a forward direction between a rest state and an ejection state, for ejecting fluid from the chamber through the outlet port as it moves from the rest state to the ejection state;

the paddle positioned to substantially close the inlet port when in the rest state, the paddle and the inlet port defining an aperture there between; and, the paddle including first means to reduce fluid flow chamber through the aperture toward the inlet port as the paddle moves from the rest state to the ejection state.

The first means to reduce fluid flow may include one or more baffles on a forward surface of the paddle to inhibit or deflect fluid flow.

The first means to reduce fluid flow may include an upturned portion of the peripheral region of the forward surface.

The first means to reduce fluid flow may include at least one depression, groove projection, ridge or the like on the forward surface of the paddle.

The projection or depression may comprise a truncated pyramid.

The ridge or groove may be linear, elliptical, circular, arcuate or any appropriate shape.

Where multiple ridges or grooves are provided they may be parallel, concentric or intersecting.

The forward surface of the wall of the chamber adjacent the fluid inlet port may also be provided with second means to reduce fluid flow through the aperture toward the inlet port as the paddle moves from the rest state to the ejection state.

The second means may be an angling into the chamber of the forward surface of the wall of the chamber around the fluid inlet port.

The rear surface of the paddle may include third means to encourage fluid flow into the chamber as the paddle moves from the ejection state to the rest state.

The third means may be an angling into the chamber of the rear surface of the paddle.

The angling of the rear surface may be limited to the peripheral region of the rear surface.

The port may be configured to encourage fluid flow into the chamber as the paddle moves from the ejection state to the rest state.

The surface of the wall of the inlet port adjacent to paddle may be angled into the chamber such that the aperture decreases in area toward the chamber.

The paddle may be a constant thickness.

In another aspect the invention provides a liquid ejection device including:

a fluid chamber having:

a fluid outlet port in a wall of the chamber;

a fluid inlet port in a wall of the chamber;

a paddle located in the chamber and moveable in a forward direction between a rest state and an ejection state, for ejecting fluid from the chamber through the outlet port as it moves from the rest state to the ejection state; wherein the paddle is positioned to substantially close the inlet port when in the rest state, the paddle and the port defining an aperture there between; and, wherein the paddle has a forward surface, the forward surface having a central portion and a peripheral portion, at least part of the peripheral portion extending outwardly from the central portion in the first direction.

All of the peripheral portion may extend at a constant angle to the forward direction or it may be curved.

The central portion may extend generally perpendicular to the first direction. The paddle may be of a constant thickness.

The forward surface of the wall of the chamber defining the inlet port may be planar but is preferably angled upward into the chamber.

The inlet port is preferably defined by the wall of the chamber extending over the end of a fluid passage way. At least part of the walls of the chamber are preferably angled toward the chamber to form a convergent inlet in the downstream direction.

In another broad form the invention provides a liquid ejection device including:

a fluid chamber having:

a fluid outlet port in a wall of the chamber;

a fluid inlet port in a wall of the chamber;

a paddle located in the chamber between the fluid outlet port and the fluid inlet port and having a front surface and a rear surface and moveable in a forward direction between a rest position and an ejection position, for ejecting fluid from the chamber through the outlet port as it moves from the rest position to the ejection position;

at least one aperture between the paddle and the chamber wall or walls when the paddle is at the rest position, the ejection position and positions there between, such that fluid may flow between the front and rear of the paddle via the at least one aperture; and, wherein the surface of the wall or walls of the chamber adjacent to the at least one aperture are configured to reduce fluid flow through the at least one aperture toward the inlet port as the paddle moves from the rest position to the ejection position.

In a further aspect, the invention provides a liquid ejection device including:

a fluid chamber having:

a fluid outlet port in a wall of the chamber;

a fluid inlet port in a wall of the chamber;

a paddle located in the chamber between the fluid outlet port and the fluid inlet port and having a front surface and a rear surface and moveable in a forward direction between a rest position and an ejection position, for ejecting fluid from the chamber through the outlet port as it moves from the rest position to the ejection position; wherein there is at least one aperture between the paddle and the chamber wall or walls when the paddle is at the rest position, the ejection position and positions there between, such that fluid may flow between the front and rear of the paddle via the at least one aperture; and, including an angling into the chamber of the surface of the wall of the chamber around the fluid inlet port.

In another aspect of the invention also provides a method of manufacturing a micro mechanical device which includes a movable paddle, the method utilising semi conductor fabrication techniques and including the steps of:

a) depositing a first layer of sacrificial material;

b) depositing at least a second layer of sacrificial material on a selected part or parts of the first layer; and c) depositing a paddle forming layer of material over the first and second layers of sacrificial material to form a non-planar paddle.

The step b) may include depositing a one or more additional layers of sacrificial material on selected parts of the second layer.

The additional layer or layers may be deposited on all of the second layer or only on part of the second layer. The paddle so formed may thus be multi-levelled.

Preferably the sacrificial material is a polyimide.

Preferably the second layer is deposited to lie under the peripheral region of the as yet unformed paddle.

BRIEF DESCRIPTION OF THE DRAWINGS

Notwithstanding any other forms which may fall within the scope of the present invention, preferred forms of the invention will now be described, by way of example only, with reference to the accompanying drawings, in which.

DESCRIPTION OF PREFERRED AND OTHER EMBODIMENTS

In the preferred embodiment, a compact form of liquid ejection device is provided which utilises a thermal bend actuator to eject ink from a nozzle chamber.

Figure 1:
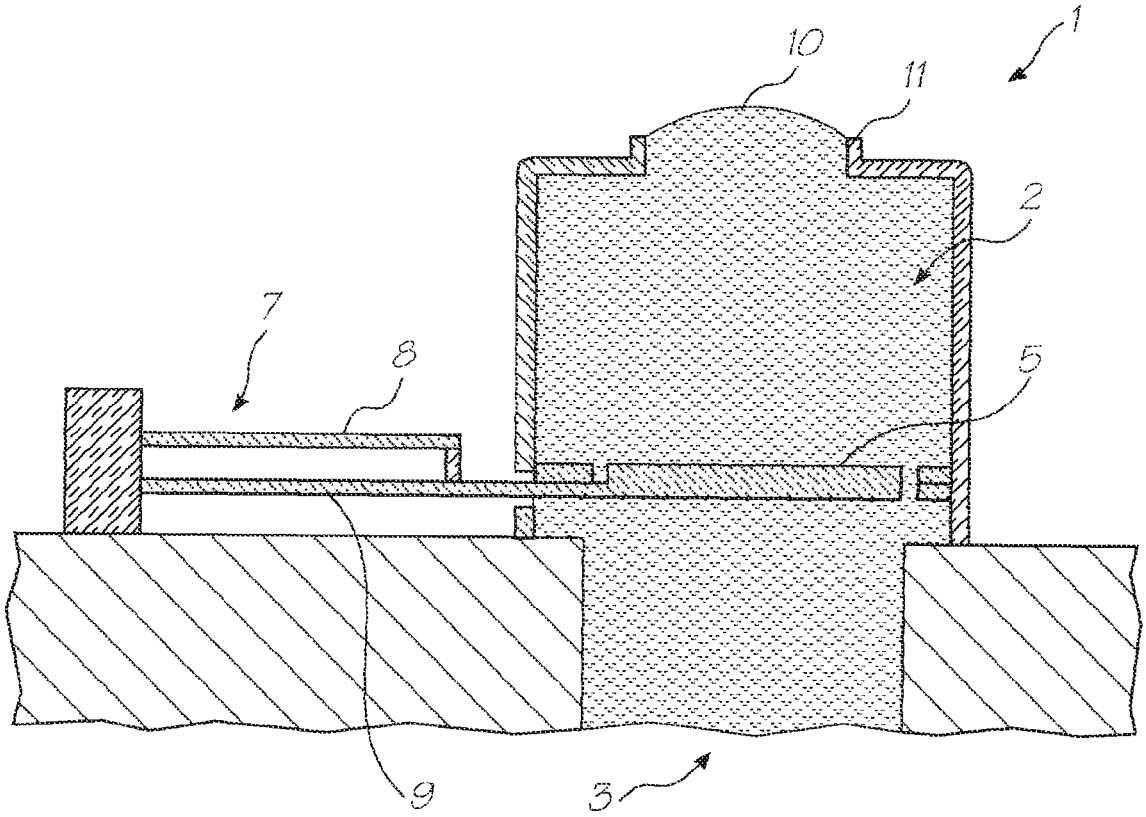
FIG. 1 illustrates schematically a sectional view of a thermal bend actuator type ink injection device.

As shown in FIG. 1, there is provided an ink ejection arrangement 1 which comprises a nozzle chamber 2 which is normally filled with ink so as to form a meniscus 10 around an ink ejection nozzle 11 having a raised rim. The ink within the nozzle chamber 2 is resupplied by means of ink supply channel 3.

The ink is ejected from a nozzle chamber 2 by means of a thermal actuator 7 which is rigidly interconnected to a nozzle paddle 5. The thermal actuator 7 comprises two arms 8, 9 with the bottom arm 9 being interconnected to an electrical current source so as to provide conductive heating of the bottom arm 9. When it is desired to eject a drop from the nozzle chamber 2, the bottom arm 9 is heated so as to cause rapid expansion of this arm 9 relative to the top arm 8. The rapid expansion in turn causes a rapid upward movement of the paddle 5 within the nozzle chamber 2. This initial movement causes a substantial increase in pressure within the nozzle chamber 2 which in turn causes ink to flow out of the nozzle 11 causing the meniscus 10 to bulge. Subsequently, the current to the heater 9 is turned off so as to cause the paddle 5 to begin to return to its original position. This results in a substantial decrease in the pressure within the nozzle chamber 2. The forward momentum of the ink outside the nozzle rim 11 results in a necking and breaking of the meniscus so as to form a meniscus and a droplet of ink 18 (see FIG. 4). The droplet 18 continues forward onto the ink print medium as the paddle returns toward its rest state. The meniscus then returns to the position shown in FIG. 1, drawing ink past the paddle 5 in to the chamber 2. The wall of the chamber 2 forms an aperture in which the paddle 5 sits with a small gap there between.

Figure 2:
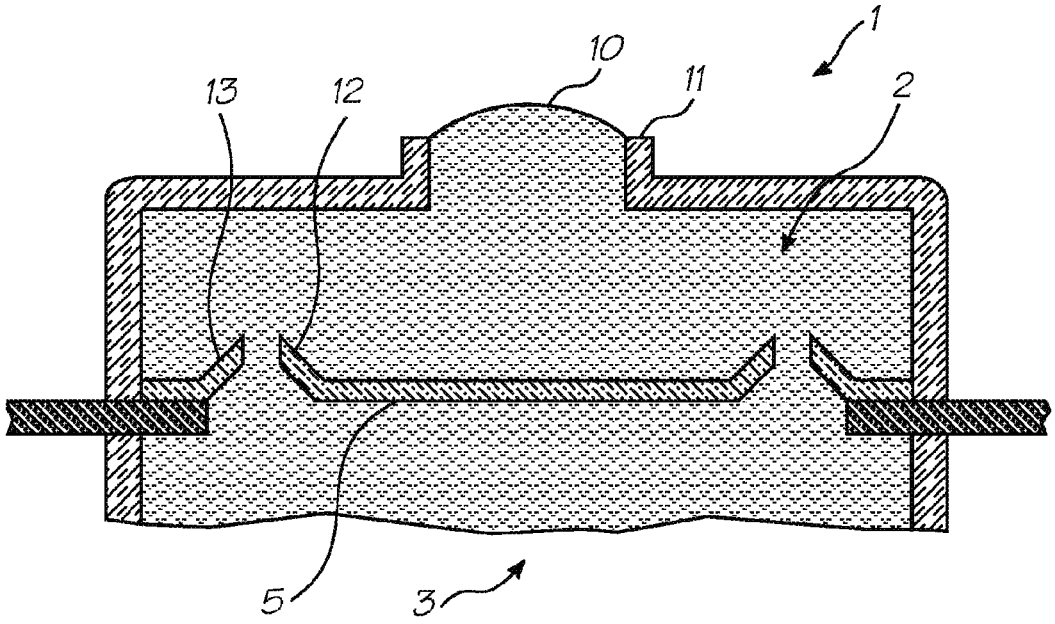
FIG. 2 illustrates a sectional view though a nozzle chamber of a first embodiment with the paddle in a quiescent state.
Figure 3:
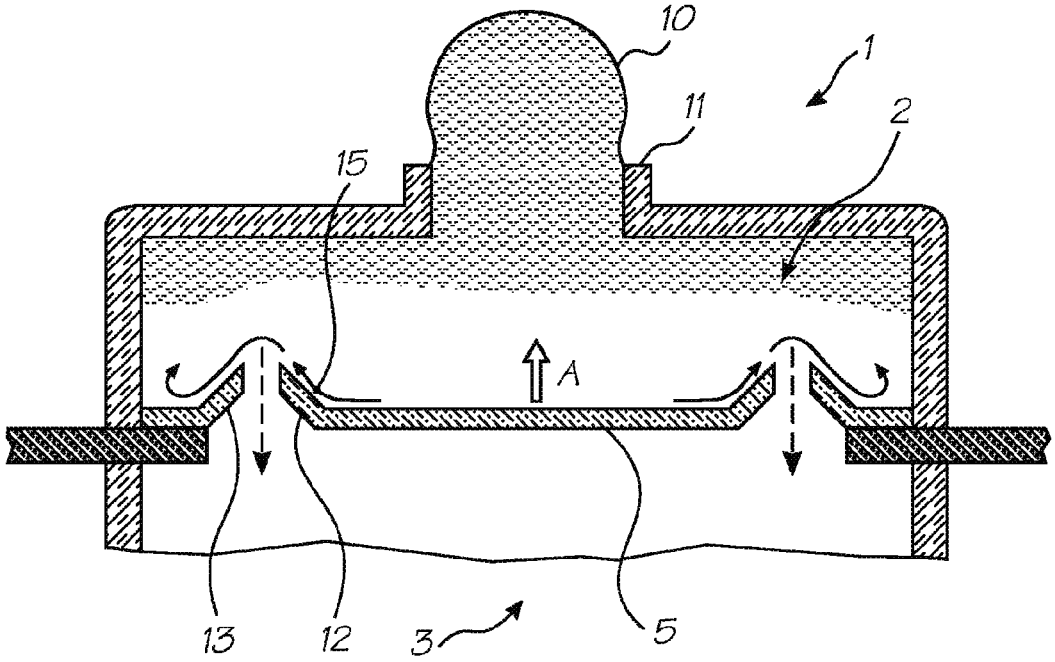
FIG. 3 illustrates the fluid flow in the nozzle chamber of the first embodiment during a forward stroke.

FIG. 2 illustrates a sectional view through the nozzle chamber 2 of a first embodiment of the invention when in an idle state. The nozzle chamber paddle 5 includes an upturned edge portion 12 which cooperates with the chamber wall edge portion 13. There is an aperture 16 between the paddle 5 and the edge portion 13. Initially, when it is desired to eject a drop of ink, the actuator (not shown) is activated so as to cause the paddle 5 to move rapidly in an upward (or forward) direction, indicated by arrow A in FIG. 3. As a result, the pressure within the nozzle chamber 2 substantially increases and ink begins to flow out of the nozzle chamber, as illustrated in FIG. 3, with the meniscus 10 rapid bulging. The movement of the paddle 5 and increased pressure also cause fluid to flow from the centre of the paddle 5 outwards toward the paddle's peripheral edge as indicated by arrows 15. The fluid flow across the paddle is diverted by the upturned edge portion 12 so as to tend to flow over the aperture 16 between the paddle 5 and the chamber wall edge portion 13 rather than through the aperture. There is still a leakage flow through the aperture 16, but this is reduced compared to devices in which one or both of the paddle 5 and wall 13 are planar. The profiling of the edges portions 12 and 13 thus results in a substantial reduction in the amount of fluid flowing around the surface of the paddle upon upward movement. Higher pressure is achieved in the nozzle chamber 2 for a given paddle deflection, resulting in greater efficiency of the nozzle. A greater volume of ink may be ejected for the same paddle stroke or a reduced paddle stroke (and actuator power consumption) may be used to eject the same volume of ink, compared to a planar paddle device.

Whilst the peripheral portion 13 of the chamber wall defining the inlet port is also angled upwards, it will be appreciated that this is not essential.

Figure 4:
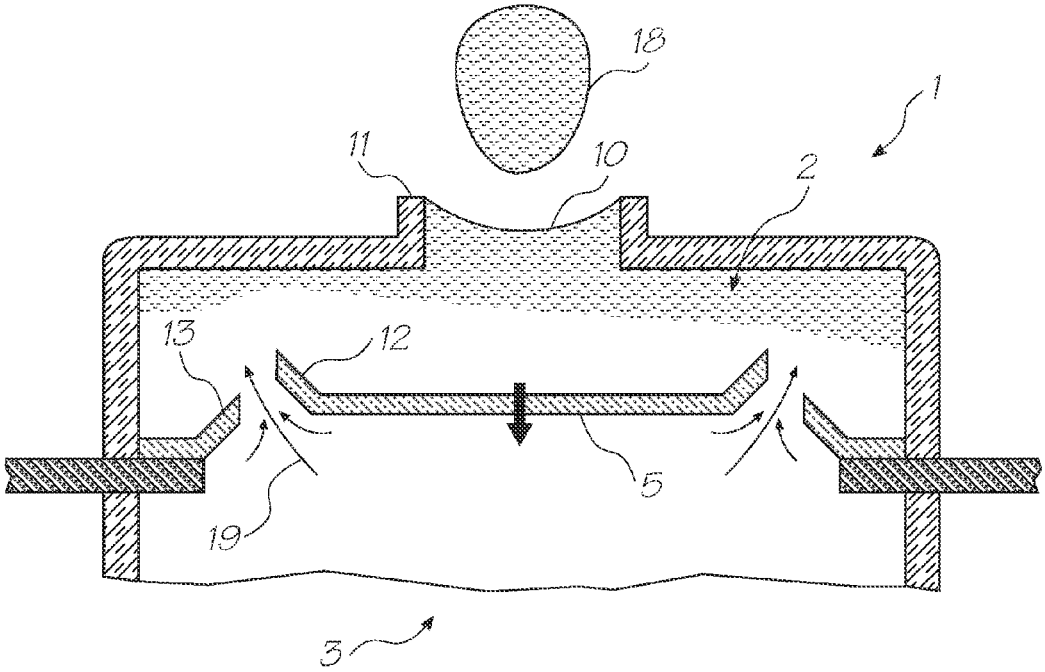
FIG. 4 illustrates the fluid flow in the nozzle chamber of the first embodiment during mid-term stroke.

Subsequently, the thermal actuator is deactivated and the nozzle paddle rapidly starts returning to its rest position as illustrated in FIG. 4. This results in a general reduction in the pressure within the nozzle chamber 2 which in turn results in a general necking and breaking of a drop 18. The meniscus 10 is drawn into the chamber 2 and the returns to the position shown in FIG. 2, resulting in ink being drawn into the chamber, as indicated by arrows 19 in FIG. 4.

The profiling of the lower surfaces of the edge regions 12, 13 also assists in channelling fluid flow into the top portion of the nozzle chamber compared to simple planar surfaces.

The rapid refill of the nozzle chamber in turn allows for higher speed operation.

Process of Manufacture

Figure 5:
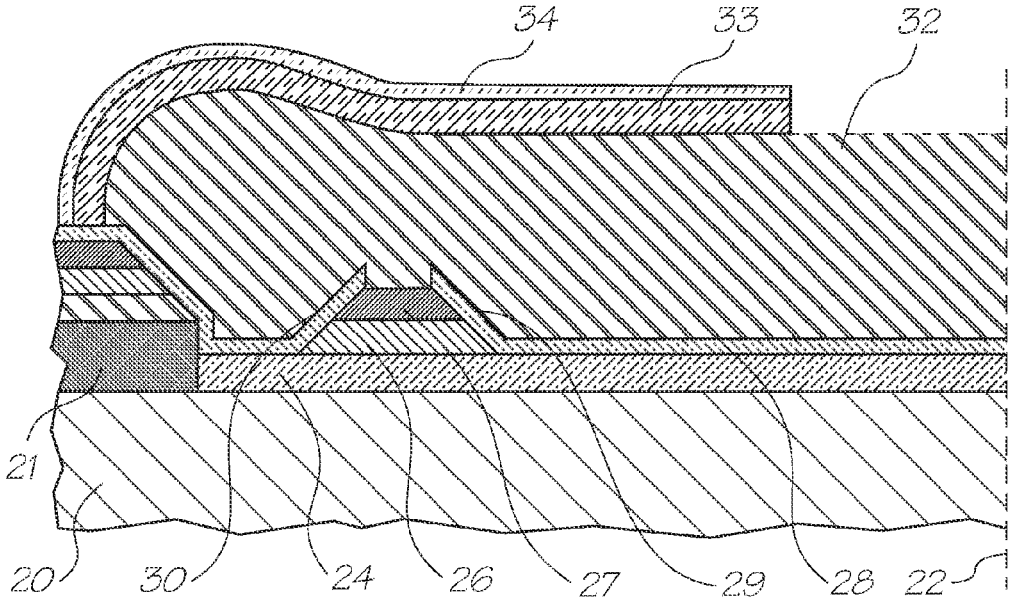
FIG. 5 illustrates the manufacturing process in the construction of a first embodiment of the invention.

The arrangement in FIG. 5 illustrates one-half of a nozzle chamber, which is symmetrical around axis 22. The manufacturing process can proceed as follows:

1. The starting substrate is a CMOS wafer 20 which includes CMOS circuitry 21 formed thereon in accordance with the required electrical drive and data storage requirements for driving a thermal bend actuator 5.
2. The next step is to deposit a 2 micron layer of photoimageable polyimide 24. The layer 24 forms a first sacrificial layer which is deposited by means of spinning on a polyimide layer; soft-baking the layer, and exposing and developing the layer through a suitable mask. A subsequent hard-bake of the layer 24 shrinks it to 1 micron in height.
3. A second polyimide sacrificial layer is photoimaged utilizing the method of step 2 so as to provide for a second sacrificial layer 26. The shrinkage of the layer 26 causes its edges to be angled inwards.
4. Subsequently, a third sacrificial layer 27 is deposited and imaged again in accordance with the process previously outlined in respect of step 2. This layer forms a third sacrificial layer 27. Again the edges of layer 27 are angled inwards. It will be appreciated that the single layer 26 may be sufficient by itself and that layer 27 need not be deposited.
5. The paddle 28 and bicuspid edges, e.g. 29, 30 are then formed, preferably from titanium nitride, through the deposit of a 0.25 micron TiN layer. This TiN layer is deposited and etched through an appropriate mask.
6. Subsequently, a fourth sacrificial layer 32 is formed, which can comprise 6 microns of resist, the resist being suitably patterned.
7. A 1 micron layer of dielectric material 33 is then deposited at a temperature less than the decomposition temperature of resist layer 32.
8. Subsequently, a fifth resist layer 34 is also formed and patterned.
9. A 0.1 micron layer of dielectric material, not shown, is then deposited.
10. The dielectric material is then etched anisotropically to a depth of 0.2 microns.
11. A nozzle guard, not shown, if required, is then attached to the wafer structure.
12. Subsequently the wafer is prepared for dicing and packaging by mounting the wafer on an UV tape.
13. The wafer is then back etched from the back surface of the wafer utilizing a deep silicon etching process so as to provide for the ink channel supply while simultaneously separating the printhead wafer into individual printhead segments.

Figure 6:
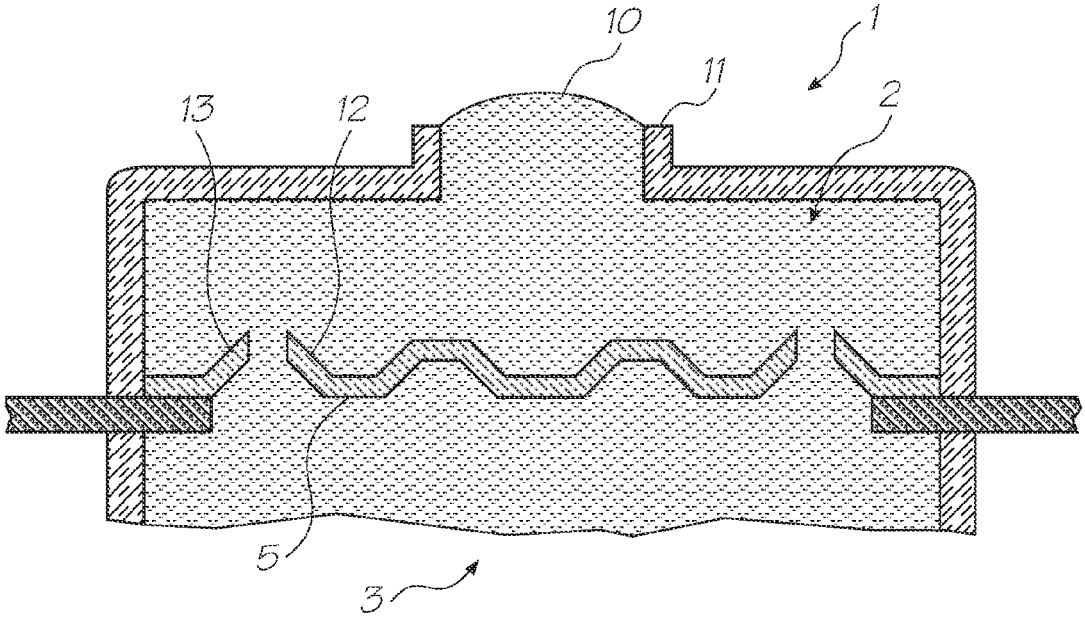
FIG. 6 is a sectional view through a second embodiment of the invention.
Figure 7:
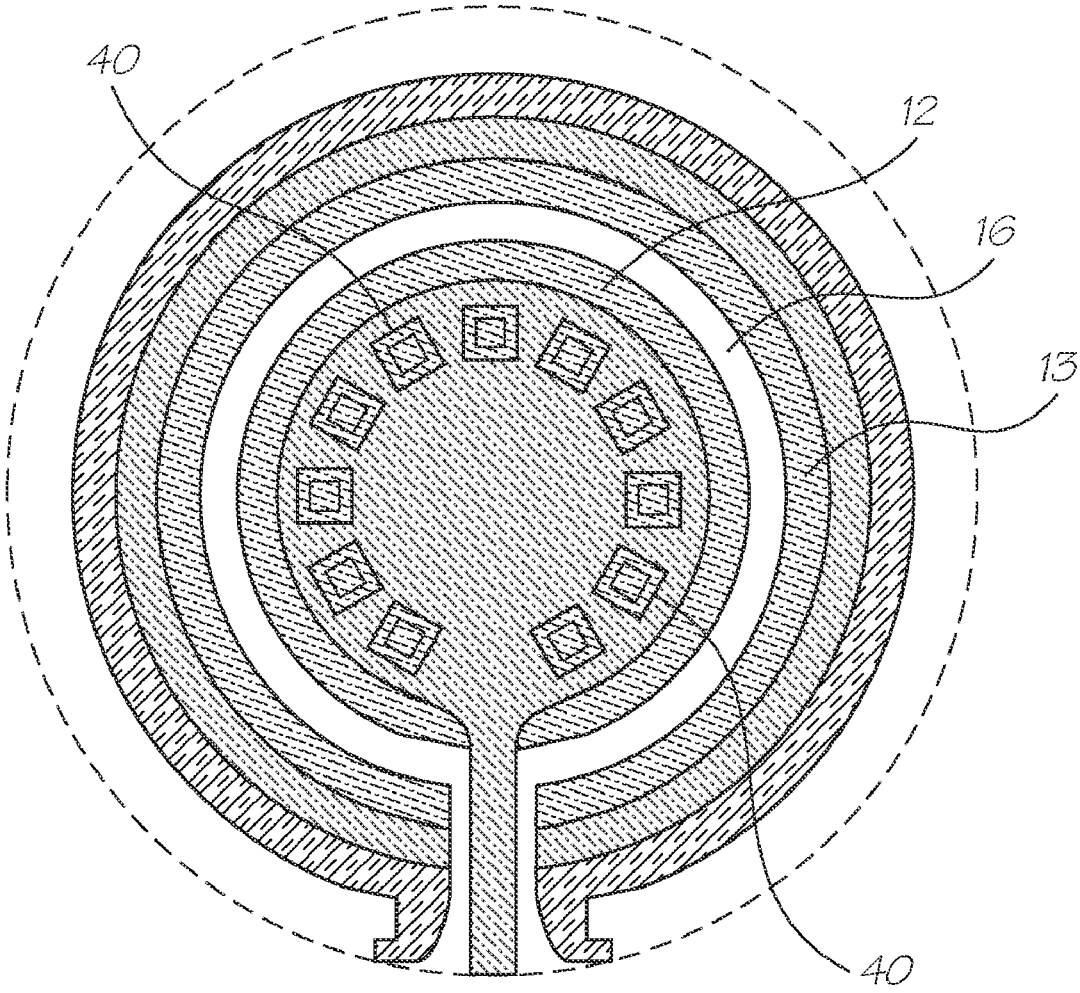
FIG. 7 is a sectional plan view of the embodiment of FIG. 6.

Referring to FIGS. 6 and 7 there is shown a second embodiment having similar components to those of the first embodiment, and so the same numbers are used as for the first embodiment.

In the FIGS. 6 and 7 embodiment the paddle is formed with a series of truncated pyramidal protrusions 40 in the central portion of the paddle. These protrusions 40 aid in reducing fluid flow outward from the centre of the paddle 5 as the paddle moves upward. Whilst the FIGS. 6 and 7 embodiment is provided with a series of discrete truncated pyramidal protrusions 40, a series of ridges may be provided instead. Such ridges may be paralleling, concentric or intersecting. The ridges may be elliptical, circular, arcuate or any other shape.

Figure 8:
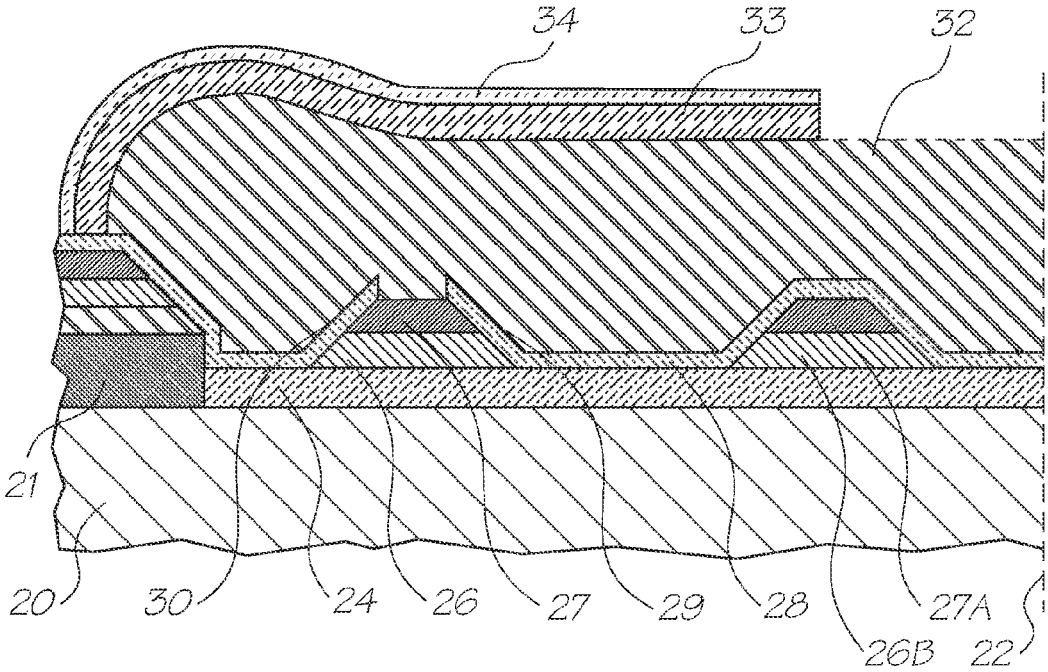
FIG. 8 illustrates the manufacturing process in construction of the second embodiment of the invention.

FIG. 8 illustrates the manufacturing process of the embodiment of FIGS. 6 and 7. The process is the same as that described with reference to FIG. 5 except that at steps 3 and 4, the sacrificial layers 26 and 27 are also deposited to be underneath the as yet unformed central portion of the paddle layer 28, as indicated by the numerals 26B and 27A.

It would be appreciated by a person skilled in the art that numerous variations and/or modifications may be made to the present invention as shown in the specific embodiment without departing from the spirit or scope of the invention as broadly described. The present embodiments are, therefore, to be considered in all respects to be illustrative and not restrictive.

The invention claimed is:

1. An ejection arrangement for a printhead nozzle, the arrangement comprising:

a chamber having an inlet defined by edge portions of a first side of the chamber and an ejection port defined in a second side of the chamber; and an ejection member located in the chamber between the edge portions, the ejection member being operable to cause ejection of fluid in the chamber through the ejection port and subsequent refill of fluid into the chamber through the inlet, wherein the edge portions are configured to reduce fluid flow through a space between the edge portions and the ejection member during said ejection, wherein the edge portions surround the inlet and are angled into the chamber from the first side of the chamber.

2. An ejection arrangement according to claim 1, wherein said operation of the ejection member is caused by conductive heating of a portion of the ejection member.

* * * * *